US012268317B2

(12) United States Patent
Sinn et al.

(10) Patent No.: US 12,268,317 B2
(45) Date of Patent: Apr. 8, 2025

(54) BED SHEET ASSEMBLY AND METHOD FOR FABRICATING SAME

(71) Applicants: Jeanna Sinn, Avon, CT (US); Colton Sinn, Avon, CT (US)

(72) Inventors: Jeanna Sinn, Avon, CT (US); Colton Sinn, Avon, CT (US)

( * ) Notice: Subject to any disclaimer, the term of this patent is extended or adjusted under 35 U.S.C. 154(b) by 576 days.

(21) Appl. No.: 17/589,141

(22) Filed: Jan. 31, 2022

(65) Prior Publication Data

US 2023/0240455 A1 Aug. 3, 2023

(51) Int. Cl.
*A47G 9/02* (2006.01)

(52) U.S. Cl.
CPC ..... *A47G 9/0246* (2013.01)

(58) Field of Classification Search
CPC ..... A47G 9/02; A47G 9/0246; A47G 2009/0276; A47G 9/023; A47G 9/04
See application file for complete search history.

(56) References Cited

U.S. PATENT DOCUMENTS 4,069,526 A 1/1978 Deikel
4,266,308 A * 5/1981 Shatz ..... A47G 9/02 5/497
4,771,496 A 9/1988 Cobb
5,072,470 A * 12/1991 Lysiak ..... A47C 21/022 5/498
5,457,830 A * 10/1995 Fox ..... A47G 9/02 5/513
5,884,349 A * 3/1999 Gretsinger ..... A47G 9/02 5/497
6,108,836 A * 8/2000 Keene, III ..... A47G 9/02 5/482
6,725,477 B2 * 4/2004 Ciaglia ..... A47G 9/02 5/500
7,100,223 B1 * 9/2006 Anthony ..... A47G 9/0238 5/482
7,380,297 B2 * 6/2008 Bauer ..... A47G 9/0207 5/482
8,745,787 B1 * 6/2014 Heimlich ..... A47C 21/022 5/659
8,776,287 B1 * 7/2014 Jarrett ..... A47G 9/0246 5/482
8,950,024 B1 * 2/2015 Hudson ..... A47G 9/02 5/500
10,016,078 B1 * 7/2018 McDermott ..... A47G 9/0238
(Continued)

FOREIGN PATENT DOCUMENTS

GB 2216409 A * 10/1989 ..... A47G 9/02

*Primary Examiner* — Eric J Kurilla
(74) *Attorney, Agent, or Firm* — Getz Balich LLC

(57) ABSTRACT

A bed sheet assembly includes a fitted sheet and a top sheet. The fitted sheet is configured to at least partially envelope a mattress. The fitted sheet includes a top portion, a side portion, and a bottom portion. The top sheet includes an upper top sheet end, a lower top sheet end opposite the upper top sheet end, and a first top sheet side and a second top sheet side opposite the first top sheet side. The top sheet is attached to the top portion of the fitted sheet by a joint. The joint includes a longitudinal segment extending in a longitudinal direction between the upper top sheet end and the lower top sheet end. The joint further includes a lateral segment extending in a lateral direction between the first top sheet side and the second top sheet side.

13 Claims, 6 Drawing Sheets

(56) References Cited

U.S. PATENT DOCUMENTS

| | | | | |
|---|---|---|---|---|
| 11,910,945 | B1 * | 2/2024 | Connolly | A47G 9/0238 |
| 2007/0101496 | A1 * | 5/2007 | Ho | A47G 9/02 5/482 |
| 2009/0151072 | A1 | 6/2009 | Jones, III | |
| 2010/0107337 | A1 * | 5/2010 | Taylor | A47C 21/022 5/498 |
| 2011/0289686 | A1 * | 12/2011 | Chose | A47G 9/0207 5/497 |
| 2013/0055501 | A1 * | 3/2013 | Lisboa | A47G 9/0253 5/494 |
| 2016/0058214 | A1 * | 3/2016 | Preston | A47G 9/0238 5/497 |
| 2019/0313718 | A1 * | 10/2019 | Voy | A47G 9/0238 |
| 2021/0196050 | A1 * | 7/2021 | Kujawa | A47C 21/022 |
| 2021/0244209 | A1 * | 8/2021 | Craft | A47G 9/02 |
| 2021/0378423 | A1 * | 12/2021 | Weinhoffer | A47G 9/0223 |
| 2021/0401195 | A1 * | 12/2021 | Miles | A47G 9/0246 |
| 2022/0322841 | A1 * | 10/2022 | Maurer | A47C 21/022 |
| 2022/0330730 | A1 * | 10/2022 | Hunter | A47G 9/0246 |

* cited by examiner

BED SHEET ASSEMBLY AND METHOD FOR FABRICATING SAME

BACKGROUND

1. Technical Field

This disclosure relates generally to bed sheets for a bed, and more particularly, to a bed sheet assembly configured for separating sleepers in a bed.

2. Background Information

Bed sheets have typically included a fitted sheet disposed on a mattress, and a top sheet positioned above the fitted sheet. While widely used, conventional sheets present a number of drawbacks, particularly where two or more sleepers may be present in a bed. A first sleeper may be disrupted as a result of inadvertent physical contact with a second sleeper or as a result of the second sleeper pulling on the sheets. Further, while the configuration of conventional sheet sets is relatively simple, the acts of making a bed with the sheets or folding the sheets can be burdensome. Accordingly, what is needed is a bed sheet assembly which addresses one or more of the above-noted concerns.

SUMMARY

It should be understood that any or all of the features or embodiments described herein can be used or combined in any combination with each and every other feature or embodiment described herein unless expressly noted otherwise.

According to an aspect of the present disclosure, a bed sheet assembly for a mattress for a bed includes a fitted sheet and a top sheet. The fitted sheet is configured to at least partially envelope the mattress. The fitted sheet includes a top portion configured to contact a top of the mattress, a side portion connected to the top portion and configured to contact and surround a sidewall of the mattress, and a bottom portion connected to the side portion and configured to contact a bottom of the mattress. The top portion of the fitted sheet includes an upper fitted sheet end, a lower fitted sheet end opposite the upper fitted sheet end, and a first fitted sheet side and a second fitted sheet side opposite the first fitted sheet side. Each of the first fitted sheet side and the second fitted sheet side extend from the upper fitted sheet end to the lower fitted sheet end. The top sheet includes an upper top sheet end, a lower top sheet end opposite the upper top sheet end, and a first top sheet side and a second top sheet side opposite the first top sheet side. Each of the first top sheet side and the second top sheet side extend from the upper top sheet end to the lower top sheet end. The top sheet is attached to the top portion of the fitted sheet by a joint. The joint includes a longitudinal segment extending in a longitudinal direction between the upper top sheet end and the lower top sheet end. The joint further includes a lateral segment extending in a lateral direction between the first top sheet side and the second top sheet side.

In any of the aspects or embodiments described above and herein, the top sheet may be fixedly attached to the top portion of the fitted sheet by the joint.

In any of the aspects or embodiments described above and herein, the top sheet may be stitched to the top portion of the fitted sheet along the joint.

In any of the aspects or embodiments described above and herein, the joint may be configured so that the top sheet is selectively detachable from the top portion of the fitted sheet along the joint.

In any of the aspects or embodiments described above and herein, a first portion of the longitudinal segment of the joint may be located on the top portion of the fitted sheet and a second portion of the longitudinal segment of the joint may be located on the side portion of the fitted sheet.

In any of the aspects or embodiments described above and herein, the lateral segment of the joint may be located on the bottom portion of the fitted sheet.

In any of the aspects or embodiments described above and herein, the lateral segment of the joint may substantially extend a lateral distance defined from the first fitted sheet side to the second fitted sheet side.

In any of the aspects or embodiments described above and herein, the longitudinal segment of the joint may be connected to the lateral segment of the joint.

In any of the aspects or embodiments described above and herein, the top sheet may include a top longitudinal portion extending from a proximate end of the longitudinal segment to the upper top sheet end.

In any of the aspects or embodiments described above and herein, the top longitudinal portion may have a first longitudinal distance defined from the proximate end of the longitudinal segment to the upper top sheet end. The top portion of the fitted sheet may have a second longitudinal distance defined from the upper fitted sheet end to the lower fitted sheet end. The first longitudinal distance may be greater than 10 percent of the second longitudinal distance.

In any of the aspects or embodiments described above and herein, the top portion of the fitted sheet may have a first area, the top sheet may have a second area, and the second area may be greater than 200 percent of the first area.

In any of the aspects or embodiments described above and herein, the fitted sheet may include a pocket located on the side portion.

According to another aspect of the present disclosure, a bed sheet assembly for a mattress for a bed includes a fitted sheet and a top sheet. The fitted sheet is configured to at least partially envelope the mattress. The fitted sheet includes a top portion configured to contact a top of the mattress, a side portion connected to the top portion and configured to contact and surround a sidewall of the mattress, and a bottom portion connected to the side portion and configured to contact a bottom of the mattress. The top portion of the fitted sheet includes an upper fitted sheet end, a lower fitted sheet end opposite the upper fitted sheet end, and a first fitted sheet side and a second fitted sheet side opposite the first fitted sheet side. Each of the first fitted sheet side and the second fitted sheet side extends from the upper fitted sheet end to the lower fitted sheet end. The fitted sheet further includes a first joint portion of a joint. The first joint portion includes a first longitudinal segment and a first lateral segment. The top sheet includes an upper top sheet end, a lower top sheet end opposite the upper top sheet end, and a first top sheet side and a second top sheet side opposite the first top sheet side. Each of the first top sheet side and the second top sheet side extends from the upper top sheet end to the lower top sheet end. The top sheet further includes a second joint portion of the joint. The second joint portion includes a second longitudinal segment and a second lateral segment. The second joint portion of the top sheet is configured to be selectively attachable and selectively detachable from the first joint portion of the fitted sheet.

In any of the aspects or embodiments described above and herein, the joint may include one of a hook-and-loop fastener, a zipper, or a plurality of buttons.

In any of the aspects or embodiments described above and herein, a first portion of the first longitudinal segment of the joint may be located on the top portion of the fitted sheet and a second portion of the first longitudinal segment of the joint may be located on the side portion of the fitted sheet.

In any of the aspects or embodiments described above and herein, the first lateral segment may be located on the bottom portion of the fitted sheet.

According to another aspect of the present disclosure, a method for fabricating a bed sheet assembly for a mattress for a bed includes providing a fitted sheet configured to at least partially envelope the mattress. The fitted sheet includes a top portion configured to contact a top of the mattress, a side portion connected to the top portion and configured to contact and surround a sidewall of the mattress, and a bottom portion connected to the side portion and configured to contact a bottom of the mattress. The method further includes providing a top sheet and attaching the top sheet to the top portion of the fitted sheet with a joint. The joint includes a longitudinal segment extending in a longitudinal direction and a lateral segment extending in a lateral direction. The lateral direction is substantially perpendicular to the longitudinal direction.

In any of the aspects or embodiments described above and herein, the step of attaching the top sheet to the top portion of the fitted sheet with the joint may include fixedly attaching the top sheet to the top portion of the fitted sheet with stitching along the joint.

In any of the aspects or embodiments described above and herein, a portion of the longitudinal segment of the joint may be located on the side portion of the fitted sheet.

In any of the aspects or embodiments described above and herein, the lateral segment of the joint may be located on the bottom portion of the fitted sheet.

The present disclosure, and all its aspects, embodiments and advantages associated therewith will become more readily apparent in view of the detailed description provided below, including the accompanying drawings.

DETAILED DESCRIPTION

Figure 1:
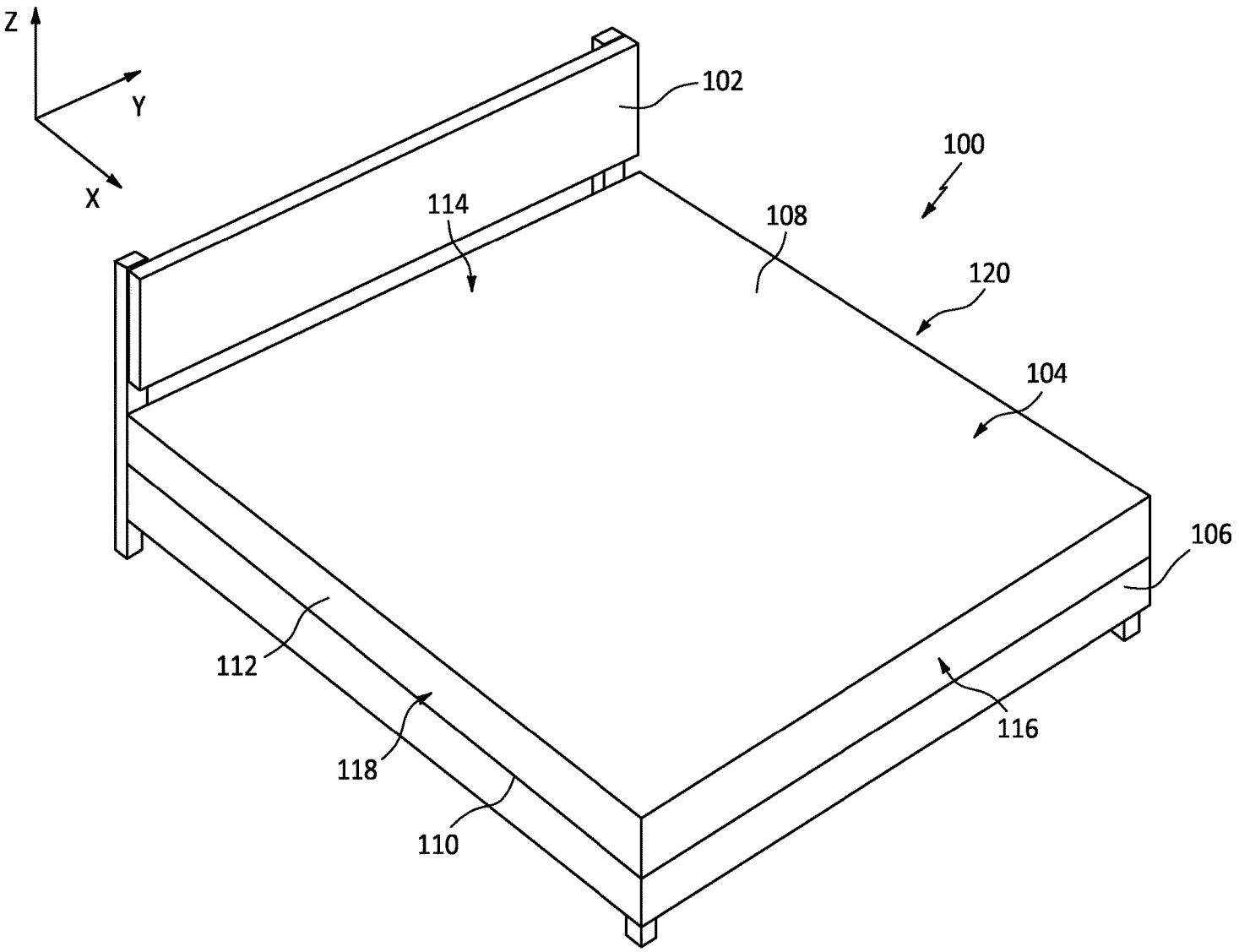
FIG. 1 illustrates a perspective view of an exemplary bed.

The present disclosure is directed to a bed sheet assembly. As will be clear from the description below, the bed sheet assembly can be used for a wide variety of bed and/or mattress configurations. To facilitate the description herein, embodiments of the present disclosure bed sheet assembly 20 will be primarily described as they may be used with a bed including a mattress. FIG. 1 illustrates an example of such a bed 100 including a frame 102 and a mattress 104. The frame 102 may include, or otherwise provide support for, a base member 106 disposed underneath the mattress 104 and configured to support the mattress 104. The base member 106 of FIG. 1 is configured as a box spring supported by the frame 102, however, the present disclosure is not limited to the use of a box spring for the base member 106.

The mattress 104 includes a top 108 and a bottom 110 opposite the top 108. The mattress 104 includes a sidewall 112 extending between the top 108 and the bottom 110. The sidewall 112 defines an outer perimeter of the mattress 104. The mattress 104 includes an upper end 114 and a lower end 116 opposite the upper end 114. The mattress includes a first side 118 and a second side 120 opposite the first side 118. The first side 118 and the second side 120 extend from the upper end 114 to the lower end 116. Mattresses, such as the mattress 104, may typically have one of a variety of predetermined sizes and shapes conventionally referred to as "twin," "full," "queen," "king,", "California king," etc. The present disclosure is not limited to any particular size, shape, thickness, or other dimension of the mattress 104. To be clear, the bed 100 configuration of FIG. 1 is exemplary, and the present disclosure bed sheet assembly 20 is not limited to use with the exemplary bed 100 of FIG. 1. As used herein, the terms "top" and "bottom" refer to a vertical orientation relative to a floor upon which a bed may be disposed (e.g., along the z-axis shown in FIGS. 1 and 2). As used herein, the terms "upper" and "lower" refer to a conventional orientation of person lying on a bed, whereby the head of the person is positioned proximate the upper end of the bed and the feet of the person are positioned proximate the lower end of the bed.

Figure 2:
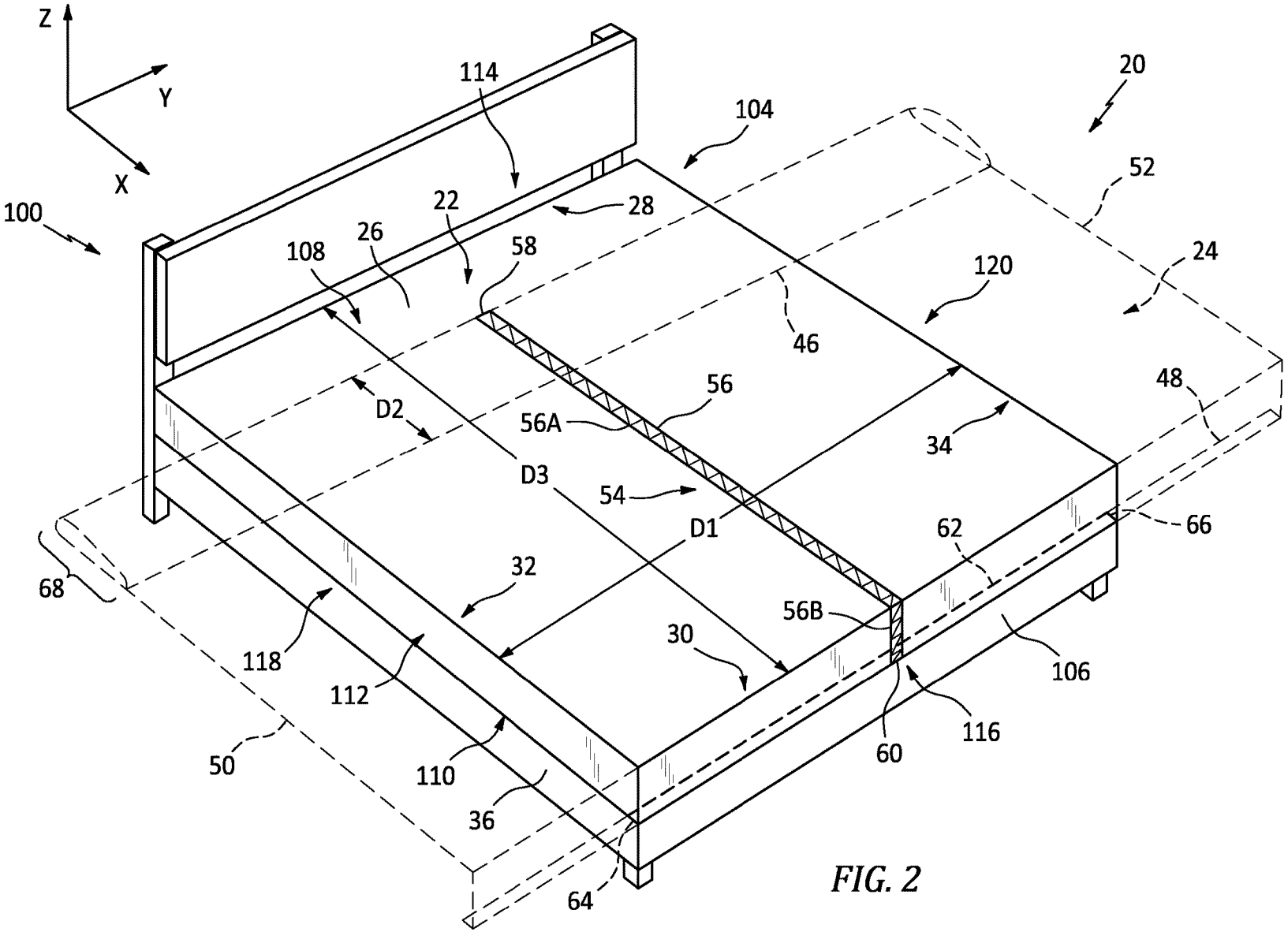
FIG. 2 is a perspective view of a bed sheet assembly positioned on the exemplary bed of FIG. 1, in accordance with one or more embodiments of the present disclosure.
Figure 3:
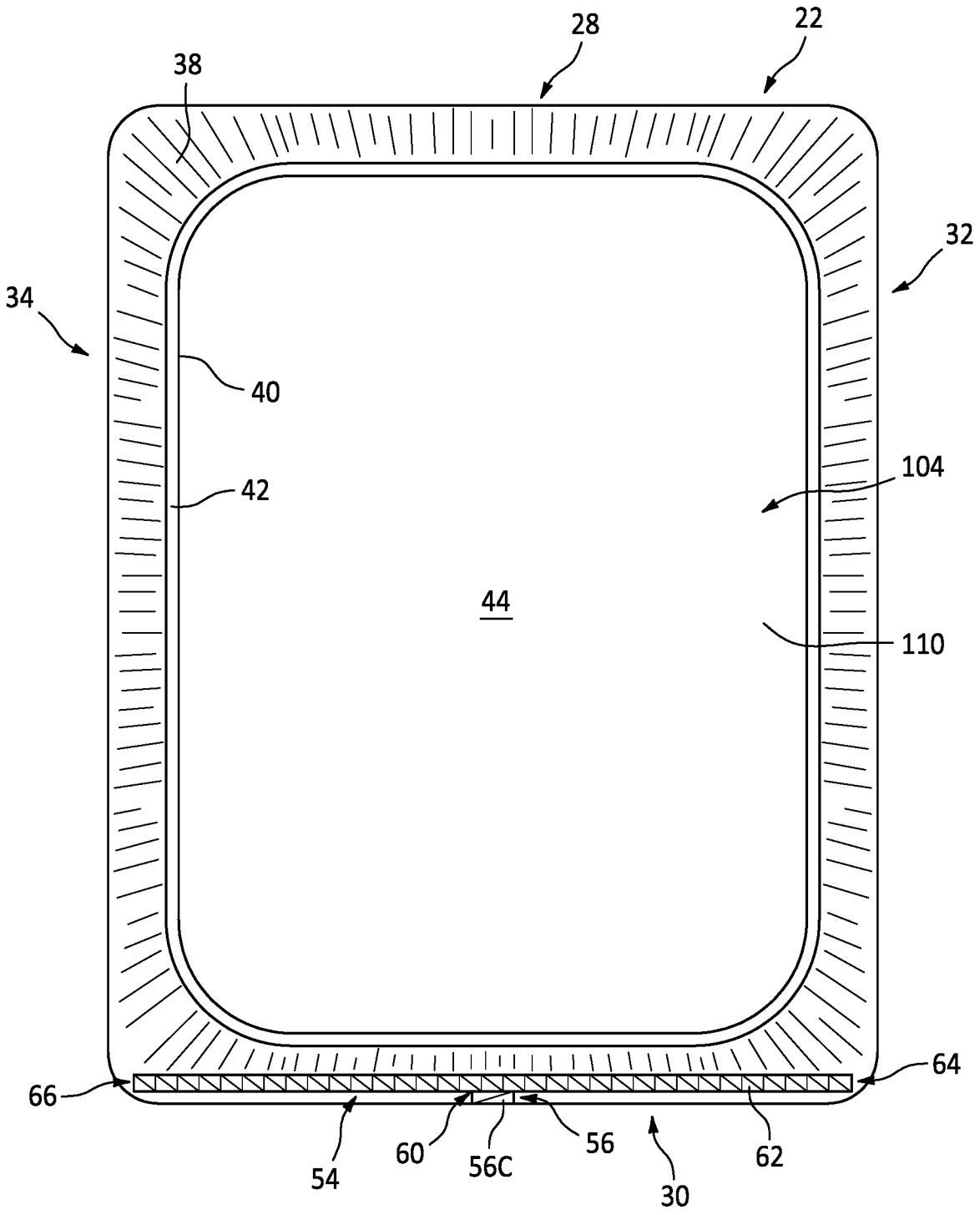
FIG. 3 illustrates a bottom view of the bed sheet assembly of FIG. 2, in accordance with one or more embodiments of the present disclosure.

Referring to FIGS. 2-3, bed sheet assembly 20 embodiments according to the present disclosure include a fitted sheet 22 and a top sheet 24. FIG. 2 illustrates the bed sheet assembly 20 installed on the mattress 104. For clarity, the top sheet 24 is illustrated in an outstretched condition. FIG. 3 illustrates a bottom view of the fitted sheet 22 with the bed sheet assembly 20 installed on the mattress 104.

The fitted sheet 22 is configured to be installed on the mattress 104 so as to at least partially envelope the mattress 104. The fitted sheet 22 includes a top portion 26 configured to contact the top 108 of the mattress 104. The top portion 26 includes an upper end 28 and a lower end 30 opposite the upper end 28. The top portion 26 includes a first side 32 and a second side 34 opposite the first side 32. The first side 32 and the second side 34 extend from the upper end 28 to the lower end 30. The fitted sheet 22 is configured to be oriented on the mattress 104 such that the upper end 28 of the fitted sheet 22 is positioned adjacent the upper end 114 of the mattress 104 and the lower end 30 of the fitted sheet 22 is positioned adjacent the lower end 116 of the mattress 104. The fitted sheet 22 includes a side portion 36 connected to the top portion 26. The side portion 36 extends from the top portion 26 along the upper end 28, the lower end 30, the first side 32, and the second side 34. The side portion 36 is configured to contact the sidewall 112 of the mattress 104. The fitted sheet 22 includes a bottom portion 38 connected to the side portion 36. The bottom portion 38 extends between the side portion 36 and a terminal end 40 of the fitted sheet 22 defining an opening 44 through which the mattress 104 can be positioned such that the fitted sheet 22 at least partially encompasses the mattress 104. The bottom portion 38 is configured to contact the bottom 110 of the mattress 104. Accordingly, the bottom portion 38 may be positioned between the mattress 104 and the base member 106 when the fitted sheet 22 is installed on the bed 100.

In some embodiments, the bottom portion 38 of the fitted sheet 22 may include a retention member 42 configured to positionally secure the fitted sheet 22 relative to the mattress. The retention member 42 may be positioned at, adjacent, or otherwise proximate the terminal end 40 of the fitted sheet 22 about all or portion of the opening 44. The retention member 42 may typically include an elastic band, however, the present disclosure is not limited to the use of an elastic band for the retention member 42.

The top sheet 24 includes an upper end 46 and a lower end 48 opposite the upper end 46. The top sheet 24 includes a first side 50 and a second side 52 opposite the first side 50. The first side 50 and the second side 52 extend from the upper end 46 to the lower end 48.

Figure 4:
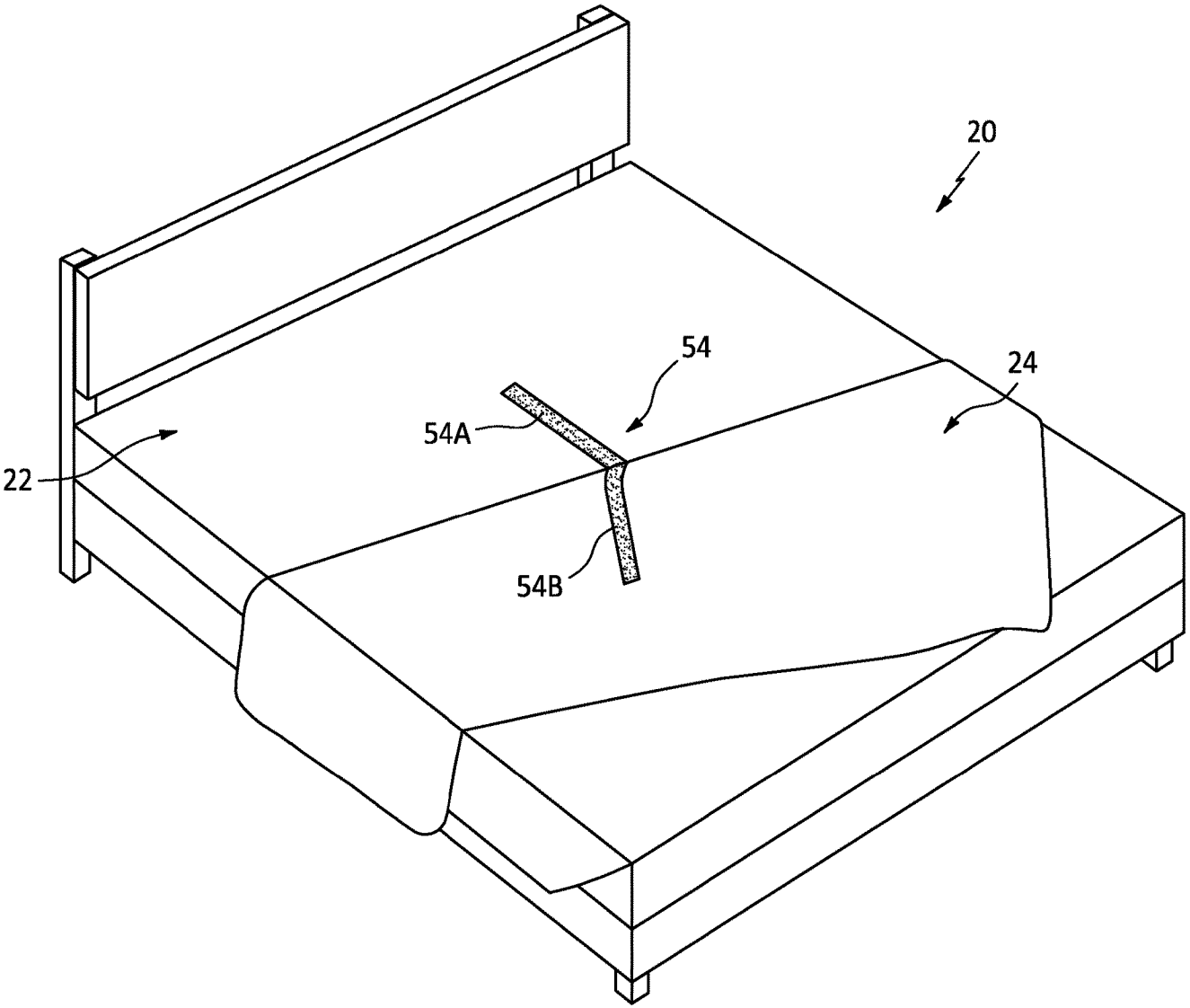
FIG. 4 illustrates a perspective view of a bed sheet assembly positioned on the exemplary bed of FIG. 1, in accordance with one or more embodiments of the present disclosure.

Referring to FIGS. 2-4, the top sheet 24 is attached to the fitted sheet 22 by a joint 54. In some embodiments, the top sheet 24 may be fixedly attached to the fitted sheet 22 along the joint 54. The term "fixedly attached," as used herein with regard to the attachment of the top sheet 24 and the fitted sheet 22 at the joint 54, refers to a permanent or substantially permanent attachment requiring significant disassembly or destruction of the bed sheet assembly 20 components and/or materials in order to separate the top sheet 24 and the fitted sheet 22 along the joint 54. For example, the top sheet 24 and the fitted sheet 22 may be stitched together along the joint 54. As shown in FIG. 4, in some other embodiments, the fitted sheet 22 may include a first joint portion 54A of the joint 54 and the top sheet 24 may include a second joint portion 54B of the joint 54. The second joint portion 54B may be selectively attachable to, and selectively detachable from, the first joint portion 54A such that the fitted sheet 22 and the top sheet 24 can be readily attached or detached along the joint 54. Examples of fasteners which may be used for the first joint portion 54A and the second joint portion 54B of the joint 54 may include hook-and-loop fasteners, zippers, buttons, and the like.

The joint 54 includes a longitudinal segment 56 extending in a longitudinal direction (e.g., generally along the x-axis shown in FIGS. 1 and 2) between the upper end 46 of the top sheet 24 and a lower end 48 of the top sheet 24. As used herein, the term "longitudinal" refers to the direction generally extending between the upper end 46 of the top sheet 24 and the lower end 48 of the top sheet 24. However, it should be understood that portions of the longitudinal segment 56 may have alternative orientations (e.g., vertical orientations), particularly where the bed sheet assembly 20 is installed on a bed such as the bed 100. The longitudinal segment 56 extends between a proximate end 58 and a distal end 60 opposite the proximate end 58. The longitudinal segment 56 of the joint 54 is configured to separate two sleepers who may be positioned on opposite lateral sides of the longitudinal segment 56. The longitudinal segment 56 may extend along a substantial center of the fitted sheet 22 and the top sheet 24. For example, the longitudinal segment 56 may be approximately centered between the first side 32 and the second side 34 of the fitted sheet 22. However, the present disclosure is not limited to a central position of the longitudinal segment 56 and the position of the longitudinal segment 56 may be selected to provide a greater area of the fitted sheet 22 and the top sheet 24 to one sleeper relative to another.

Referring to FIGS. 2, 3, 5, and 6, the longitudinal segment 56 of FIG. 2 includes a first portion 56A of the longitudinal segment 56 on the top portion 26 of the fitted sheet 22. The longitudinal segment 56 may further include a second portion 56B of the longitudinal segment 56 on the side portion 36 of the fitted sheet 22, as shown, for example, in FIGS. 2 and 5. The longitudinal segment 56 of FIG. 3 may further include a third portion 56C of the longitudinal segment 56 on the bottom portion 38 of the fitted sheet 22, as shown, for example, in FIG. 3.

The joint 54 includes a lateral segment 62 extending in a lateral direction (e.g., generally along the y-axis shown in FIGS. 1 and 2) between the first side 50 of the top sheet 24 and the second side 52 of the top sheet 24. The lateral direction may be substantially perpendicular to the longitudinal direction along which the longitudinal segment 56 extends. The lateral segment 62 extends between a first lateral end 64 and a second lateral end 66 opposite the first lateral end 64. In some embodiments, the lateral segment 62 may extend or substantially extend a lateral distance D1 (i.e., greater than 90 percent of the lateral distance D1) defined from the first side 32 of the fitted sheet 22 to the second side 34 of the fitted sheet 22. In some other embodiments, the lateral segment 62 may extend along only a portion of the lateral distance D1 defined from the first side 32 of the fitted sheet 22 to the second side 34 of the fitted sheet 22. In some embodiments the longitudinal segment 56 (e.g., the distal end 60 of the longitudinal segment 56) of the joint 54 may be connected to the lateral segment 62. However, the present disclosure is not limited to this particular orientation of the longitudinal segment 56 and the lateral segment 62. For example, the longitudinal segment 56 and the lateral segment 62 may be spaced (e.g., longitudinally spaced) from one another.

Figure 5:
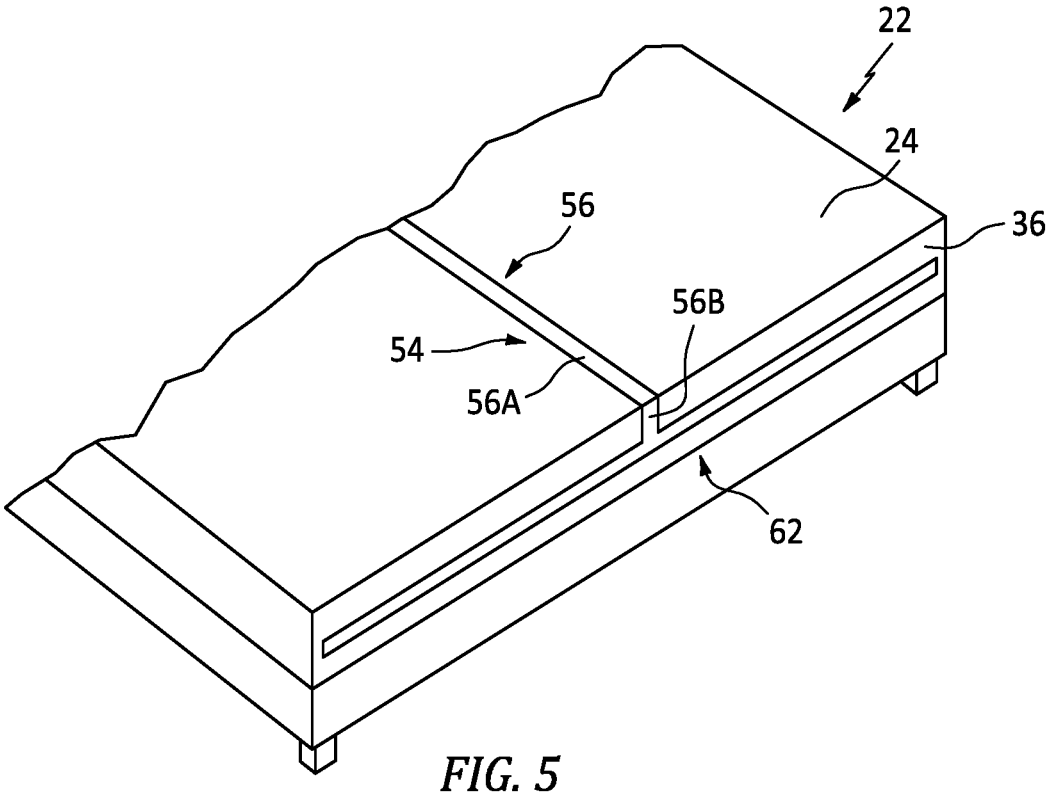
FIG. 5 illustrates a perspective view of a portion of a bed sheet assembly showing a fitted sheet and joint, in accordance with one or more embodiments of the present disclosure.
Figure 6:
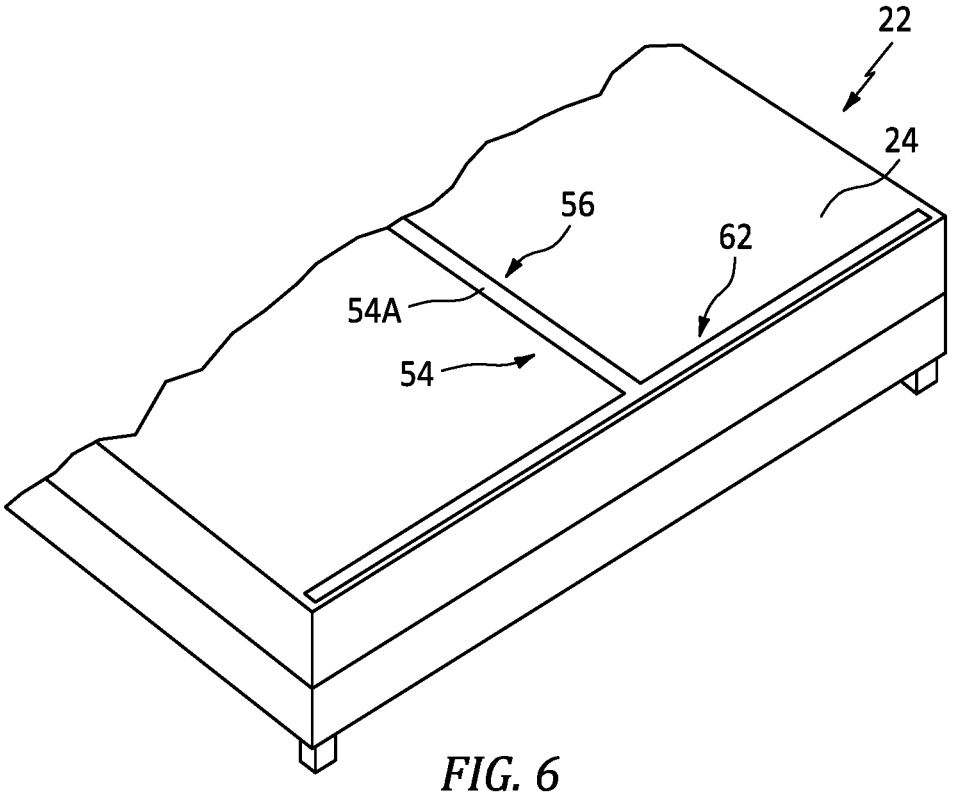
FIG. 6 illustrates a perspective view of a portion of a bed sheet assembly showing a fitted sheet and joint, in accordance with one or more embodiments of the present disclosure.

The lateral segment 62 of FIGS. 2 and 3 is located on the bottom portion 38 of the fitted sheet 22. In this position, the lateral segment 62 is positioned between the mattress 104 and the base member 106. The lateral segment 62 of the joint 54 provides additional retention of the position of the top sheet 24 relative to the fitted sheet 22. In other words, movement by a first sleeper in the bed 100 is less likely to move the fitted sheet 22 and/or the top sheet 24 proximate a second sleeper located on an opposite lateral side of the bed 100, thereby reducing the likelihood of disrupting the second sleeper. With the lateral segment 62 located on the bottom portion 38 of the fitted sheet 22, the weight of the mattress 104 on the lateral segment 62 may enhance the retention characteristics of the lateral segment 62 on the fitted sheet 22 and top sheet 24. However, the present disclosure is not limited to location of the lateral segment 62 on the bottom portion 38 of the fitted sheet 22. As shown in FIG. 5, for example, the lateral segment 62 may be located on the side portion 36 of the fitted sheet 22 adjacent the lower end 30 of the top portion 30. As shown in FIG. 6, for example, the lateral segment 62 may located on the top portion 26 of the fitted sheet 22 at or proximate the lower end 30. In some embodiments, the lateral segment 62 may be positioned at or proximate the lower end 48 of the top sheet 24. However, in alternative embodiments, the lateral segment 62 may be spaced (e.g., longitudinally spaced) from the lower end 48 of the top sheet 24.

Figure 7:
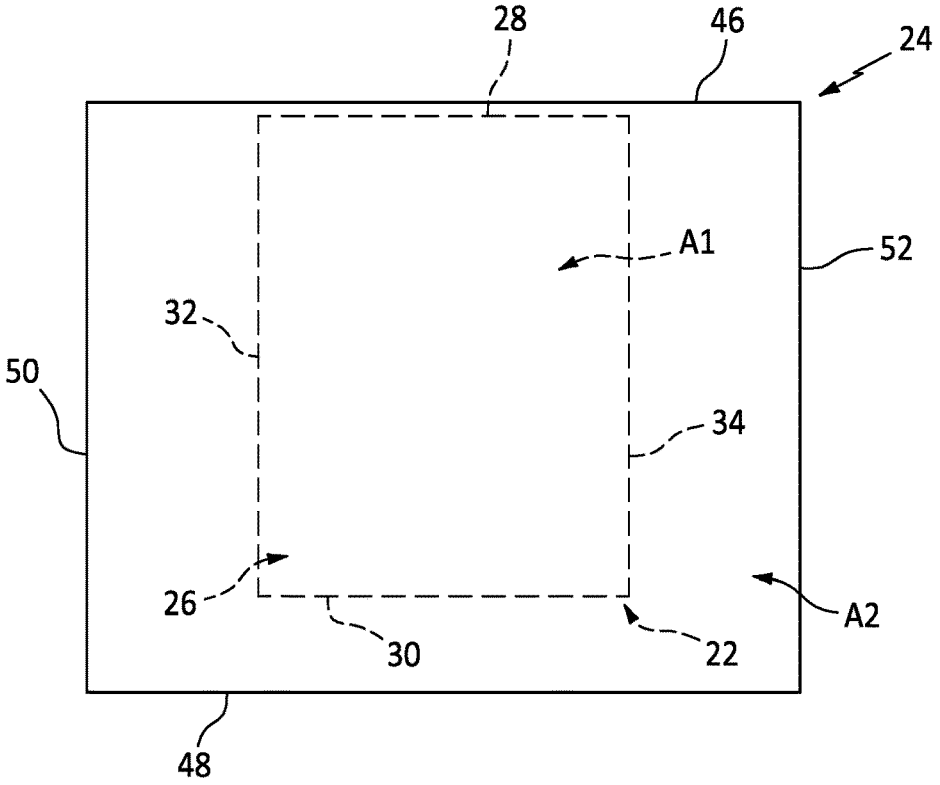
FIG. 7 illustrates a top view of a bed sheet assembly, in accordance with one or more embodiments of the present disclosure.

Referring to FIGS. 2 and 7, the top sheet 24 of FIG. 2 includes a top longitudinal portion 68. The top longitudinal portion 68 of FIG. 2 is illustrated as being folded over a longitudinally-adjacent portion of the top sheet 24. The top longitudinal portion 68 extends from the proximate end 58 of the longitudinal segment 56 to the upper end 46 of the top sheet 24. In other words, the joint 54 is not attached to the top sheet 24 in the top longitudinal portion 68. Thus, the top longitudinal portion 68 of the top sheet 24 may be configured to allow greater movement of the top sheet 24 proximate the upper end 114 of the mattress 104, for example, at a location of one or more pillows (not shown). As shown in FIG. 2, the top longitudinal portion may have a first longitudinal distance D2 defined from the proximate end 58 of the longitudinal segment 56 to the upper end 46 of the top sheet 24. As shown in FIG. 2, the top portion 26 of the fitted sheet 22 may have a second longitudinal distance D3 defined from the upper end 28 of the fitted sheet 22 to the lower end 30 of the fitted sheet 22. The first longitudinal distance D2 may be greater than 10 percent of the second longitudinal distance D3.

In some embodiments, the top sheet 24 may have a greater area than a conventional top sheet for a particular mattress size, in order to compensate for restriction in the movement of the top sheet 24 provided by the joint 54. FIG. 7 illustrates the top sheet 24 superimposed over the top portion 26 of the fitted sheet 22. The top portion 26 of the fitted sheet 22 has a first area A1. The area A1 is bounded by the upper end 28, the lower end 30, the first side 32, and the second side 34 of the top portion 26 of the fitted sheet 22. The top sheet 24 has a second area A2. The second area A2 is bounded by the upper end 46, the lower end 48, the first side 50, and the second side 52 of the top sheet 24. In some embodiments, for example, the second area A2 of the top sheet 24 may be greater than 200 percent of the first area A1 of the top portion 26 of the fitted sheet 22. In some embodiments, for example, the second area A2 of the top sheet 24 may be greater than 225 percent of the first area A1 of the top portion 26 of the fitted sheet 22.

The present disclosure bed sheet assembly 20 physically separates lateral adjacent sleepers in a bed (e.g., the bed 100) while substantially preventing pulling or other motion of the sheets 22, 24 on one lateral side of the bed from disrupting a sleeper on an opposite lateral side of the bed. Moreover, the joint 54 between the fitted sheet 22 and the top sheet 24 reduces the burden presented by making a bed or folding the sheets 22, 24. For example, because of the joint 54 between the fitted sheet 22 and the top sheet 24, once the fitted sheet 22 is installed on a bed, the top sheet 24 is already properly oriented on the bed and requires minimal additional effort to position the top sheet 24 in an aesthetically desirable condition. When folding the sheets 22, 24 a user only needs to consider folding the top sheet 24, as the fitted sheet is maintained in position relative to the top sheet 24 by the joint 54.

Figure 8:
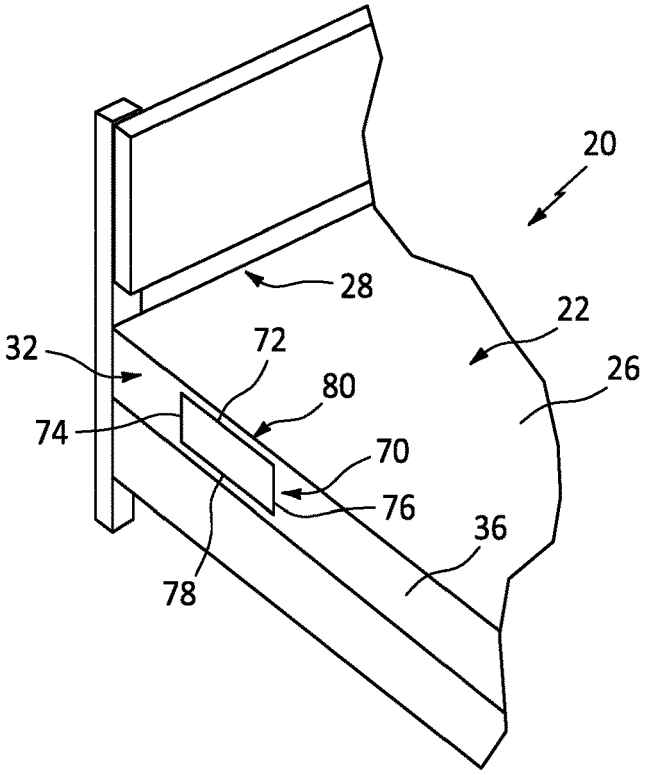
FIG. 8 illustrates a perspective view of a portion of a bed sheet assembly including a pocket, in accordance with one or more embodiments of the present disclosure.

Referring to FIG. 8, in some embodiments, the fitted sheet 22 may include one or more pockets 70 located on the side portion 36. The pocket 70 may be configured for the storage of items including, for example, smart phones, books, reading glasses, etc. The fitted sheet may include, for example, a first pocket 70 located on the side portion 36 adjacent the first side 32 of the top portion 26 and a second pocket 70 (not shown) located on the side portion 36 adjacent the second side 34 of the top portion 26. The pocket 70 may be positioned on the side portion 36 proximate the upper end 28 of the top portion 26. It should be understood, however, that the present disclosure is not limited to any particular location of the pocket 70 on the side portion 36. The pocket 70 includes a top 72 and a bottom 78 opposite the top 72. The pocket 70 includes a first side 74 and a second side 76 opposite the first side 74. Each of the first side 74 and the second side 76 may extend between the top 72 and the bottom 78. The pocket 70 may be stitched or otherwise attached to the side portion 36 along or proximate the first side 74, the second side 76, and the bottom 78. The top 72 and the side portion 36 may define an opening 80 therebetween which provides access to an interior of the pocket 70. The pocket 70 may include a material which is the same as or similar to a material of the fitted sheet 22, however, the present disclosure is not limited to any particular material for the pocket 70.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. References to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Accordingly, the present disclosure is not to be restricted except in light of the attached claims and their equivalents.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A bed sheet assembly for a mattress for a bed, the bed sheet assembly comprising:

a fitted sheet configured to at least partially envelope the mattress, the fitted sheet including a top portion configured to contact a top of the mattress, a side portion connected to the top portion and configured to contact and surround a sidewall of the mattress, and a bottom portion connected to the side portion and configured to contact a bottom of the mattress, the top portion of the fitted sheet including an upper fitted sheet end, a lower fitted sheet end opposite the upper fitted sheet end, and a first fitted sheet side and a second fitted sheet side opposite the first fitted sheet side, each of the first fitted sheet side and the second fitted sheet side extending from the upper fitted sheet end to the lower fitted sheet end;

a top sheet including an upper top sheet end, a lower top sheet end opposite the upper top sheet end, and a first top sheet side and a second top sheet side opposite the first top sheet side, each of the first top sheet side and the second top sheet side extending from the upper top sheet end to the lower top sheet end, the top sheet attached to the top portion of the fitted sheet by a joint, the joint including a longitudinal segment and a lateral segment, the longitudinal segment extending in a longitudinal direction between the upper top sheet end and the lower top sheet end, the longitudinal segment including a first segment portion on the top portion, a second segment portion on the side portion, and a third segment portion on the bottom portion, the lateral segment extending in a lateral direction between the first top sheet side and the second top sheet side, the lateral segment connected to the longitudinal segment at the third segment portion, the lateral segment located on the bottom portion of the fitted sheet.

2. The bed sheet assembly of claim 1, wherein the top sheet is fixedly attached to the top portion of the fitted sheet by the joint.

3. The bed sheet assembly of claim 2, wherein the top sheet is stitched to the top portion of the fitted sheet along the joint.

4. The bed sheet assembly of claim 1, wherein the joint is configured so that the top sheet is selectively detachable from the top portion of the fitted sheet along the joint.

5. The bed sheet assembly of claim 1, wherein the lateral segment of the joint substantially extends a lateral distance defined from the first fitted sheet side to the second fitted sheet side.

6. The bed sheet assembly of claim 1, wherein the top sheet includes a top longitudinal portion extending from a proximate end of the longitudinal segment to the upper top sheet end.

7. The bed sheet assembly of claim 6, wherein the top longitudinal portion has a first longitudinal distance defined from the proximate end of the longitudinal segment to the upper top sheet end, wherein the top portion of the fitted sheet has a second longitudinal distance defined from the upper fitted sheet end to the lower fitted sheet end, and wherein the first longitudinal distance is greater than 10 percent of the second longitudinal distance.

8. The bed sheet assembly of claim 1, wherein the top portion of the fitted sheet has a first area, wherein the top sheet has a second area, and wherein the second area is greater than 200 percent of the first area.

9. The bed sheet assembly of claim 1, wherein the fitted sheet includes a pocket located on the side portion.

10. A bed sheet assembly for a mattress for a bed, the bed sheet assembly comprising:

a fitted sheet configured to at least partially envelope the mattress, the fitted sheet including a top portion configured to contact a top of the mattress, a side portion connected to the top portion and configured to contact and surround a sidewall of the mattress, and a bottom portion connected to the side portion and configured to contact a bottom of the mattress, the top portion of the fitted sheet including an upper fitted sheet end, a lower fitted sheet end opposite the upper fitted sheet end, and a first fitted sheet side and a second fitted sheet side opposite the first fitted sheet side, each of the first fitted sheet side and the second fitted sheet side extending from the upper fitted sheet end to the lower fitted sheet end, the fitted sheet further including a first joint portion of a joint, the first joint portion including a first longitudinal segment and a first lateral segment, the first longitudinal segment including a first segment portion on the top portion, a second segment portion on the side portion, and a third segment portion on the bottom portion, the first lateral segment connected to the first longitudinal segment at the third segment portion, the first lateral segment located on the bottom portion;

a top sheet including an upper top sheet end, a lower top sheet end opposite the upper top sheet end, and a first top sheet side and a second top sheet side opposite the first top sheet side, each of the first top sheet side and the second top sheet side extending from the upper top sheet end to the lower top sheet end, the top sheet further including a second joint portion of the joint, the second joint portion including a second longitudinal segment and a second lateral segment, the second joint portion of the top sheet configured to be selectively attachable and selectively detachable from the first joint portion of the fitted sheet.

11. The bed sheet assembly of claim 10, wherein the joint includes one of a hook-and-loop fastener, a zipper, or a plurality of buttons.

12. A method for fabricating a bed sheet assembly for a mattress for a bed, the method comprising:

providing a fitted sheet configured to at least partially envelope the mattress, the fitted sheet including a top portion configured to contact a top of the mattress, a side portion connected to the top portion and configured to contact and surround a sidewall of the mattress, and a bottom portion connected to the side portion and configured to contact a bottom of the mattress;

providing a top sheet; and attaching the top sheet to the top portion of the fitted sheet with a joint, the joint including a longitudinal segment extending in a longitudinal direction and a lateral segment extending in a lateral direction, the lateral direction substantially perpendicular to the longitudinal direction, the longitudinal segment including a first segment portion on the top portion, a second segment portion on the side portion, and a third segment portion on the bottom portion, the lateral segment connected to the longitudinal segment at the third segment portion, the lateral segment located on the bottom portion of the fitted sheet.

13. The method of claim 12, wherein the step of attaching the top sheet to the top portion of the fitted sheet with the joint includes fixedly attaching the top sheet to the top portion of the fitted sheet with stitching along the joint.

* * * * *